US005129146A

United States Patent [19]

Kanemitsu et al.

[11] Patent Number: 5,129,146

[45] Date of Patent: Jul. 14, 1992

[54] METHOD OF MANUFACTURING POLY-V PULLEYS FROM SHEET METAL

[75] Inventors: Toshiaki Kanemitsu, Kobe; Kazuyuki Oda, Kako, both of Japan

[73] Assignee: Kabushiki Kaisha Kanemitsu, Akashi, Japan

[21] Appl. No.: 640,414

[22] PCT Filed: Jun. 28, 1989

[86] PCT No.: PCT/JP89/00654

§ 371 Date: Jan. 28, 1991

§ 102(e) Date: Jan. 28, 1991

[87] PCT Pub. No.: WO91/00155

PCT Pub. Date: Jan. 10, 1991

[51] Int. Cl.[5] ..... B21K 1/42

[52] U.S. Cl. ..... 29/892.3; 29/892

[58] Field of Search ..... 29/892.3, 892; 474/166, 474/168, 170, 174

[56] References Cited

U.S. PATENT DOCUMENTS

| | | | |
|---|---|---|---|
| 4,518,374 | 5/1985 | Kanemitsu | 29/892.3 |
| 4,524,595 | 6/1985 | Oda | 29/892.3 |
| 4,564,137 | 1/1986 | Nakamura | 29/892.3 |
| 4,631,946 | 12/1986 | Oda | 29/892.3 |
| 4,831,705 | 5/1989 | Kanemitsu | 29/892.3 |
| 4,913,689 | 4/1990 | Morishita et al. | 474/170 |

FOREIGN PATENT DOCUMENTS

| | | | |
|---|---|---|---|
| 88522 | 4/1987 | Japan | 29/892 |
| 124041 | 6/1987 | Japan | 29/892.3 |
| 124042 | 6/1987 | Japan | 29/892.3 |

*Primary Examiner*—P. W. Echols

*Attorney, Agent, or Firm*—Jones, Tullar & Cooper

[57] ABSTRACT

The invention presents a manufacturing method of making poly-V pulleys for bending the peripheral end part of the disc-shaped sheet metal blank in concave or convex form, flattening the bent portion so as not to elongate it in the radial direction, increasing the thickness of the peripheral end part of the disc-shaped sheet metal blank, forming the thickened sheet metal blank into a cup form, and forming poly-V grooves at the outer side of the peripheral wall of the cup-shaped blank, and the products thereof. By increasing the thickness of the part corresponding to the peripheral wall of the cup-shaped blank in the stage of the disc-shaped sheet metal blank, the peripheral wall of the cup-shaped blank may be increased in thickness by a simple press machine and at high efficiency.

13 Claims, 8 Drawing Sheets

METHOD OF MANUFACTURING POLY-V PULLEYS FROM SHEET METAL

CROSS-REFERENCE TO RELATED APPLICATION

This application contains subject matter related to application Ser. No. 07/646,730, filed Feb. 5, 1991.

TECHNICAL FIELD

The present invention relates to a method of manufacturing poly-V pulleys from sheet metal from, which way a disc-shaped sheet metal material, and the products thereof.

BACKGROUND ART

Poly-V pulleys are intended to transmit high speed rotation efficiently, and are used in the rotary transmission system of automobiles and other machines. A conventional example of such poly-V pulleys made from sheet metal made is disclosed in Layed-Open Japanese Patent Application No. 57-88929.

The manufacturing method of making poly-V pulleys from sheet metal disclosed in this Layed-Open Patent Application comprises the steps of forming a cup-shaped blank by drawing a disc-shaped sheet metal material, drawing the corner part of the boundary area of the bottom wall and peripheral wall of the cup-shaped blank to form the double folded ears projecting outside the peripheral wall in an annular shape, folding the outer edge part of the peripheral wall outward to form the ears projecting outside the peripheral wall in an annular shape, corrugating the peripheral wall by pressing in the axial direction with the bottom pattern and top pattern, and flattening the corrugated portion with the inner pattern and outer pattern by pressing from both sides to increase the wall thickness of the peripheral wall, and forming by rolling a poly-V groove at the outer side of the peripheral wall of the thus thickened cup-shaped blank.

In this manufacturing method, in order to increase the thickness of the peripheral wall of the cup-shaped blank, the disc-shaped sheet metal material is once formed into a cup shape, and its peripheral wall is increased in thickness, which requires complicated forming machines and takes a long time to increasing the wall thickness and forming.

It is therefore a primary object of the present invention to present a novel manufacturing method of making poly-V pulleys of sheet metal capable of increasing the thickness of the peripheral wall of a cup-shaped blank efficiently by simple forming equipment, and products obtained by this manufacturing method.

SUMMARY OF THE INVENTION

To achieve the above object, the invention presents a manufacturing method of making poly-V pulleys of sheet metal out of a sheet metal blank formed in a disc shape which comprises a peripheral end folding step for folding the peripheral end of the sheet metal blank in concave or convex form in a specified width range, a peripheral end thickening step for increasing the wall thickness by holding and flattening the peripheral end of the sheet metal blank folded in concave or convex form so as to be smaller in diameter than the diameter of the sheet metal blank before being folded in concave or convex form, and a cup-shaped blank forming step for bending the thickened peripheral end in one direction to form a cup-shaped blank, wherein plural V-grooves are formed at the outer side of the peripheral wall of the thus formed cup-shaped blank.

According to this manufacturing method, since the thickness of the portion corresponding to the peripheral wall of the cup-shaped blank can be increased, especially in a state of sheet metal blank formed in a disc shape, the conventional complicated thickening and forming equipment is not needed, and the portion corresponding to the peripheral wall of the cup shaped blank may be promptly increased in thickness by simple pressing equipment for pressing the disc shaped sheet metal blank from top and bottom.

When thus thickened the disc-shaped sheet metal blank is formed in a cup shape in the conventional procedure, a cup-shaped blank having a thickened peripheral wall is obtained.

In this manner, the manufacturing method of the invention is capable of increasing the thickness of the peripheral wall of a cup-shaped blank by simple equipment and at high efficiency.

The manufacturing method of the invention may, meanwhile, comprise a peripheral wall thickening step, if required, after the cup-shaped blank forming step, for further increasing the thickness of the peripheral wall by bending and forming the peripheral wall of the cup-shaped blank, and holding and compressing the bent portion from inside and outside so that the upper and lower ends may not extend in the vertical direction.

The sheet metal made poly-V pulleys of the invention are manufactured through the peripheral end thickening step, or through this step and the thickening step, and also include those manufactured by forming an indentation portion in the bottom wall of the cup-shaped blank concentrically with this cup-shaped blank, those having a bearing placed in this indentation portion, and those having the bottom wall of the indentation portion in the axial center or near the axial center of the poly-V groove forming region formed in the peripheral wall of the cup-shaped blank.

Other features and effects of the invention will be better understood and appreciated from the following detailed description of the embodiments of the invention taken in conjunction with the accompanying drawings.

BRIEF DESCRIPTION OF THE DRAWINGS

FIG. 1A to FIG. 1L are explanatory drawings for showing the manufacturing method of making poly-V pulleys of sheet metal according to an embodiment of the invention.

DESCRIPTION OF THE PREFERRED EMBODIMENTS

Figure 1D:
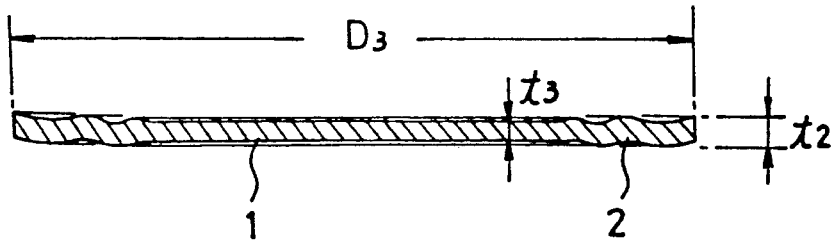

Referring now to the drawings, the invention is described in detail below.

FIG. 1A to FIG. 1L illustrate the manufacturing method of making poly-V pulleys of sheet metal according to an embodiment of the invention. This method comprises a peripheral end folding step, a peripheral end thickening step, a cup-shaped blank forming step, ear forming step, and poly-V groove forming step. Each step is described in detail below.

(1) Peripheral end folding step

In this step, a metal disc-shaped flat sheet blank (hereinafter called sheet) 1 shown in FIG. 1A is pressed, and peripheral ends 2 are folded in a concave or convex form in a specified width range as shown in FIG. 1B or FIG. 1C. The method of folding may result in either a V-form as shown in FIG. 1B or a U-form as shown in FIG. 1C, or may it result in a undulated or corrugated form (not shown in the drawing). In this peripheral end folding step, the initial diameter D1 of the sheet 1 becomes slightly shorter to D2. For example, the sheet 1 with D1=138 mm becomes a sheet 1 of D2=133.9 mm. The thickness t1 of the sheet 1 is unchanged, and if changed, the extent of the change is insignificant. This step is executed as a pretreatment for the peripheral end thickening step.

(2) Peripheral end thickening step

Figure 2:
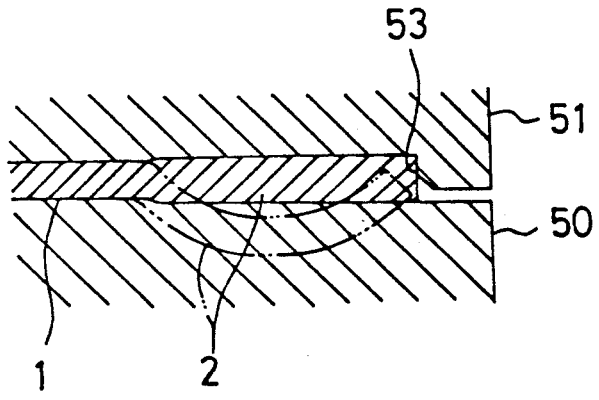
FIG. 2 is an explanatory drawing of a peripheral end thickening step.

In this step, the thickness of the peripheral ends 2 is increased by flattening the peripheral ends 2 of the sheet 1 of FIG. 1B or FIG. 1C. This step is achieved by pressing the sheet 1 by means of a bottom pattern tool 50 and a top pattern tool 51. To carry out this step the edges of the sheet 1 are held so that the diameter D3 of the sheet 1 is achieved which is smaller than the diameter D1 of the sheet 1 shown in FIG. 1A, that is, the sheet 1 before being folded into a concave or convex form. It is, however, not required that the diameter D3 of the sheet 1 be smaller than the diameter D2 of the sheet 1 shown in FIG. 1B or FIG. 1C. Therefore, this step is usually carried out of by holding the sheet 1 so that the diameter D3 of the sheet 1 after this step may be equal to the diameter D2 of the sheet 1 shown in FIG. 1B or FIG. 1C, or by holding the edges of the sheet 1 so that it may be slightly larger than the diameter D2. For achieving the dimensional relationship of the diameters D1, D2, D3, a step 53 in FIG. 2, is provided in the top pattern tool 50 or bottom pattern tool 52 for restricting the limitless diameter extent extending is provided, and the inside diameter D of the step 53 is set in a range of $D1>D\geqq D2$. The diameter D3 of the sheet 1 after this step is equal to or nearly equal to D, and for example when the angle $\theta$ of the peripheral ends 2 of the sheet 1 shown in FIG. 1B is set at 35 degrees, D3 is 134.7 mm. Usually, after this step, the peripheral ends 2 of the sheet 1 are roughly flattened, but to be precise, as shown in FIG. 1D, the surface is visibly corrugated. In this case, the corrugated shape is flattened to an invisible level in the subsequent cup-shape blank forming step. But, of course, the peripheral ends 2 may be flattened to such an extent that the corrugated surface may not be visible in this step.

The peripheral ends 2 of the sheet 1 are increased in thickness in this step, but the thickened portion may also include areas other than the peripheral ends 2. For example, when the peripheral ends 2 are corrugated as shown in FIG. 1D and the initial thickness t1 of the peripheral ends 2 is 2.6 mm, the thickness of the parts of the peripheral ends 2 of the sheet 1 after this step is 2.75 mm in the thinnest part, and 2.8 to 2.85 mm in the thickest part.

(3) Cup-shaped blank forming step

Figure 1E:
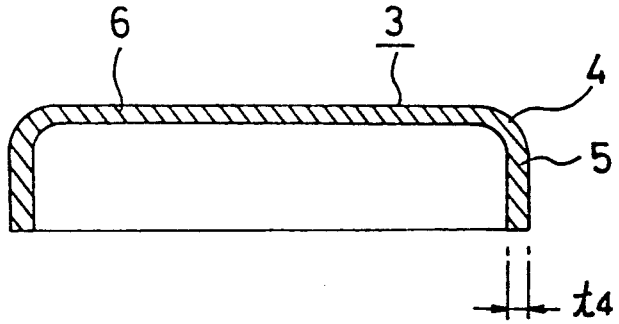
Figure 1F:
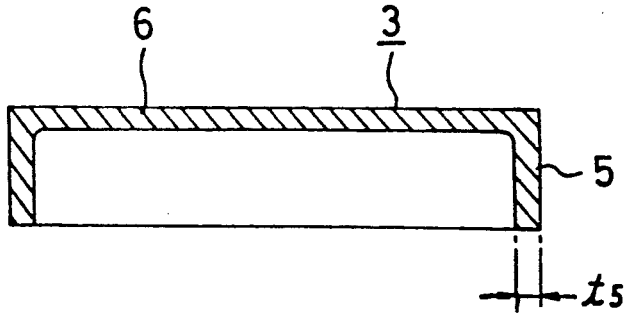
Figure 1G:
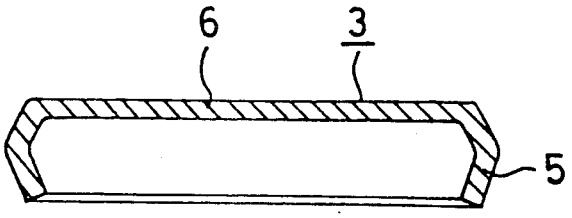
Figure 1H:
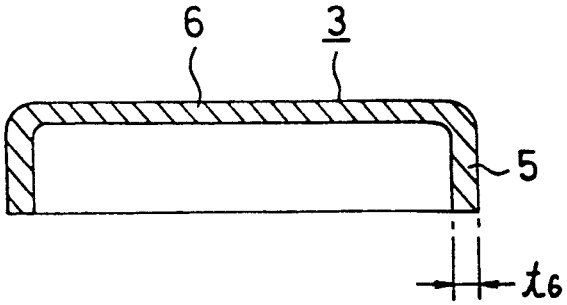
Figure 1I:
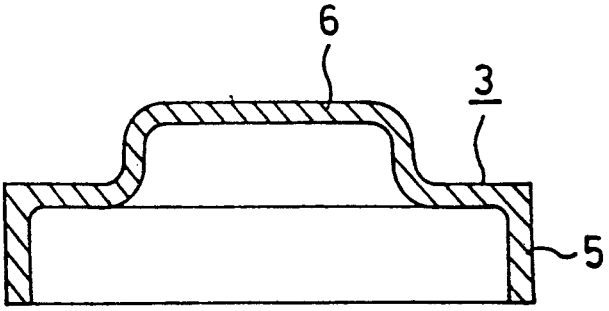

This is a step of making a cup-shaped blank 3 as shown in FIG. 1E, 1F or 1I by bending the thickened peripheral ends 2 of the sheet 1 in one direction. The cup-shaped blank 3 fabricated in this step possesses a peripheral wall 5 and a bottom wall 6, and the bottom wall 6 may be either flat as shown in FIG. 1E and FIG. 1F, or bulged out in the middle as shown in FIG. 1I, or although not shown in the drawings, the middle part may be indented or the bottom may be indented like a flat bowl.

This step may also comprise a bending step for drawing and folding the thickened peripheral ends 2 of the sheet 1 as shown in FIG. 1E, and a corner forming step for forming the curved outer circumference of the corner 4 at the crossing point of the peripheral wall 5 and bottom wall 6 of the cup-shaped blank 3 after the bending step in a right-angle or nearly right-angle shape.

Figure 3:
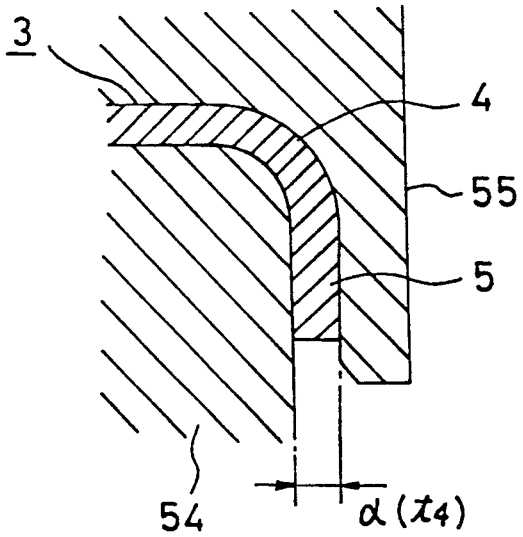
FIG. 3 is an explanatory drawing of a cup-shaped blank forming step.

In this case, bending by the drawing step is preferably executed by folding the peripheral ends (see FIG. 1D) in one direction while holding the sheet 1 in FIG. 1D between the bottom pattern tool 54 and the top pattern tool 55 shown in FIG. 3. At this time, by setting the gap between the bottom pattern tool 54 and the top pattern tool 55 slightly wider than the dimension of the wall thickness t2 of the peripheral ends 2 thickened in the peripheral end thickening step, the thickness t4 of the peripheral wall 5 of the resulting cup-shaped blank 3 is slightly greater than the thickness t2, so that the peripheral wall 5 is increased in thickness. For example, if the initial wall thickness t2 is 2.75 to 2.85 mm as shown above, the thickness t4 of the peripheral wall 5 of the cup-shaped blank fabricated in this bending step is 2.75 to 2.8 mm in the thinnest part, and 2.9 to 3.0 mm in the thickest part.

At the end of the peripheral end thickening step, if the peripheral ends 2 of the sheet 1 are visibly corrugated, the surface may be corrected in this step so that the corrugation may not be visible, but it is not absolutely necessary, and it may be corrected gradually in this bending step and the subsequent corner forming step.

Figure 4:
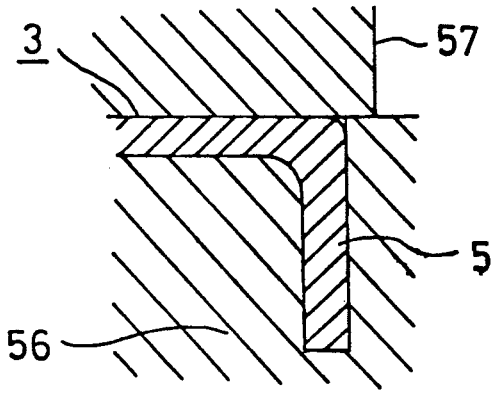
FIG. 4 is an explanatory drawing of a corner forming step.

The corner forming step is preferably executed by holding the cup-shaped blank 3 after the bending step between the bottom pattern tool 56 and the top pattern tool 57 as shown in FIG. 4. At this time, the lower end of the peripheral wall 5 is defined by the bottom pattern tool 56. Thus, the thickness t5 of the peripheral wall 5 of the cup shaped blank 3 is equal to or slightly greater than the thickness t4, and, at the same time, the corrugation of the peripheral wall 2 obvious at the end of the bending step is corrected to a high degree, and the thickness t5 becomes uniform at all parts. For example, when the cup-shaped blank 3, after the bending step is processed in the corner forming step, the thickness t5 of the peripheral wall 2 is 3.0 mm in all parts.

(4) Ear forming step

Figure 1J:
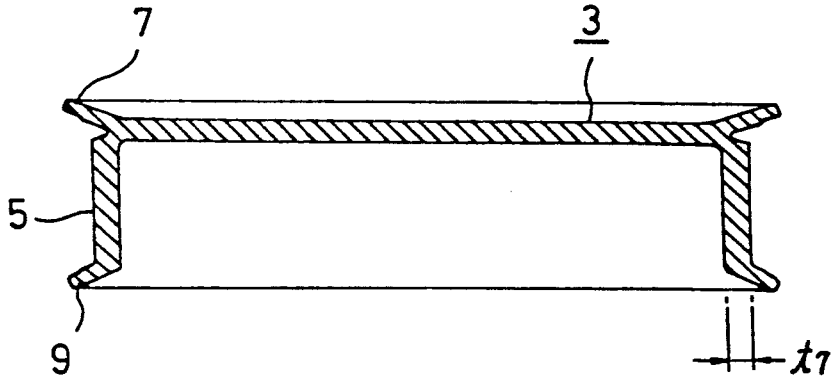

In this step, at the root portion of the peripheral wall 5 corresponding to the thickness range of the bottom wall 6 of the cup-shaped blank 3 after the cup-shaped blank forming step as shown in FIG. 1J, a first annular ear 7 extending outside of the peripheral wall 5 and a second annular ear 9 extending outside the peripheral wall 5 at the outer edge of the peripheral wall 5 of the cup-shaped blank 3 are formed by rolling.

Figure 5A:
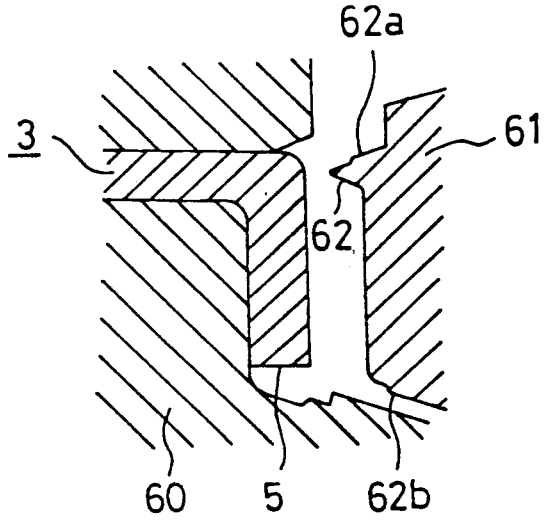
FIG. 5A to FIG. 5C are explanatory drawings of an ear forming step.
Figure 5B:
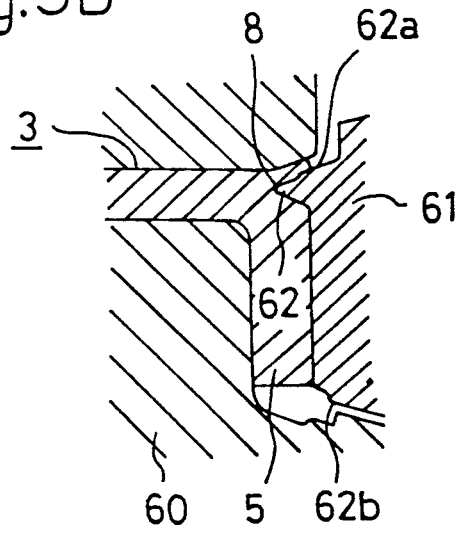
Figure 5C:
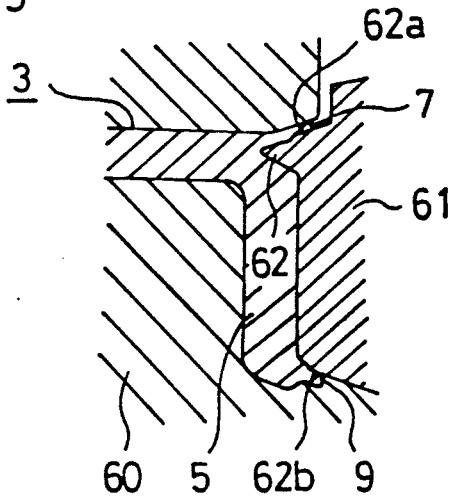

The first ear 7 is formed as follows. As shown in FIG. 5A, while rotating a circular bottom pattern tool 60 by putting the cup-shaped blank 3 thereon, a pointed protrusion 62 formed on an outer pattern tool 61 is pressed against the root portion of the peripheral wall 5 of the cup-shaped blank (at the position corresponding to the thickness range of the bottom wall 6 of the cup-shaped blank 3), and a V-groove 8 is formed in the root portion of the peripheral wall 5 as if tearing the bottom wall 6 by this protrusion 62 as shown in FIG. 5B and FIG. 5C, while the first ear 7 is formed. Thus, in the forming process of the first ear 7, a flow in the material is created in the course of gradually turning deeply as if tearing the V-groove 8 by the protrusion 62, and this material flow is led to both sides of the V-groove 8 in the midst of forming, and the material flow led upward in FIG. 5B extends outside of the peripheral wall 5, thereby forming the first ear 7 in an annular shape.

The second ear 9 is formed as follows. As shown in FIG. 5A, while rotating the circular bottom pattern tool 60 by putting the cup-shaped blank 3 thereon, the peripheral wall 5 of the cup-shaped blank 3 is pressed by the outer pattern tool 61, and the second ear 9 is extended outside of the peripheral wall 5 at the outer edge of the peripheral wall 5. The second ear 9 is formed in this way because a flow of material is created as the peripheral wall 5 is pressed by the circular inner pattern tool 60 and outer pattern tool 61 and this material flow is led to the circumference of the outer edge.

The first ear 7 and the second ear 9 may be formed simultaneously by using common pattern tools, or separately by using individual pattern tools.

After the ear forming step, the thickness t7 of the peripheral wall 5 is reduced, but since the peripheral wall 5 has been preliminarily thickened as stated above, it is possible to prevent the peripheral wall 5 from becoming thinner than it was prior to forming the first ear 7 and the second ear 9.

Thus formed first ear 7 and second ear 9 are made of a single layer.

The V-groove 8 formed in this step is to function as the groove to be engaged with the edge of the poly-V belt together with poly-V groove 10 described below. It is desired, meanwhile, to form a relief part to be free from contact with the poly-V belt in the first ear 7. This relief part may be easily formed, for example, by building up a bulge-out part 62*a* at the outside of the convex protrusion 62 as shown in FIG. 5A. Similarly, by forming a bulge-out part 62*b* at the lower side of the outer pattern tool 61, a relief part not contacting with the poly-V belt may be easily formed in the second ear 9.

This step is effected on the cup-shaped blank 3 not only after the bending step but after the corner forming step in order to obtain the first ear 7, that is, in order to have the first ear project outwardly more in the radial direction, but in the case of the two-piece laminate ear formation, as disclosed in the Laid-Open Japanese Patent Application No. 57-88929, instead of the single layer structure of the first ear 7, the same two-piece laminate ear may be formed the same as in the prior art on the cup-shaped blank 3 formed in the bending step by drawing.

(5) Poly-V groove forming step

This is a step for forming a poly-V groove 10 on the outer surface of the peripheral wall 5 of the cup-shaped blank 3.

Figure 7:
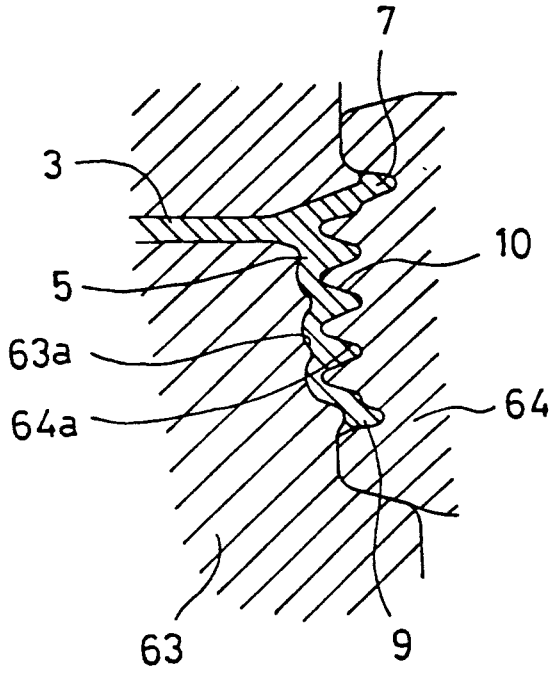
FIG. 7 is an explanatory drawing of a poly-V groove forming step.
Figure 8:
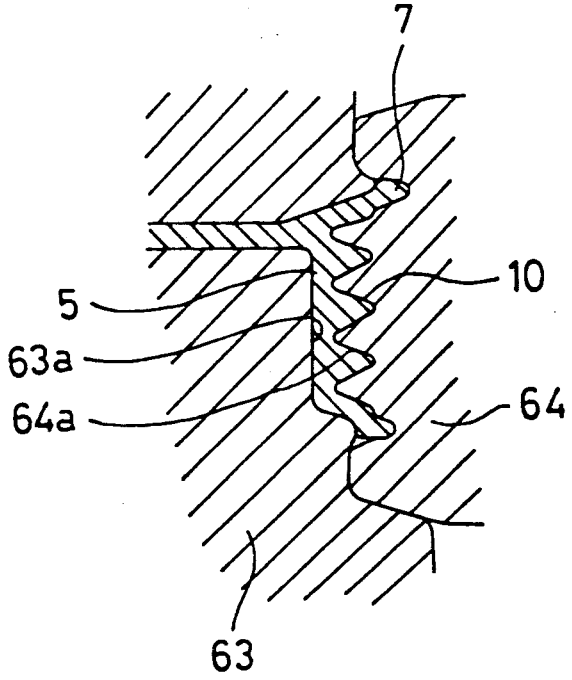
FIG. 8 is an explanatory drawing of other poly-V groove forming step.

This step is achieved by forming poly-V groove 10 composed of plural V-groove groups in the peripheral wall 5 while holding the cup-shaped blank 3 between the circular inner pattern tool 63 and the circular outer pattern tool 64 as shown in FIG. 7 or FIG. 8. Instead of forming the poly-V groove 10 by one rolling process, it is preferable to form it by plural rolling processes, comprising a preliminary poly-V groove forming step, and a finishing step for further forming the poly-V groove of the cup-shaped blank 3 after the preliminary poly-V groove forming step and finishing the depth and pitch as demanded.

Figure 1K:
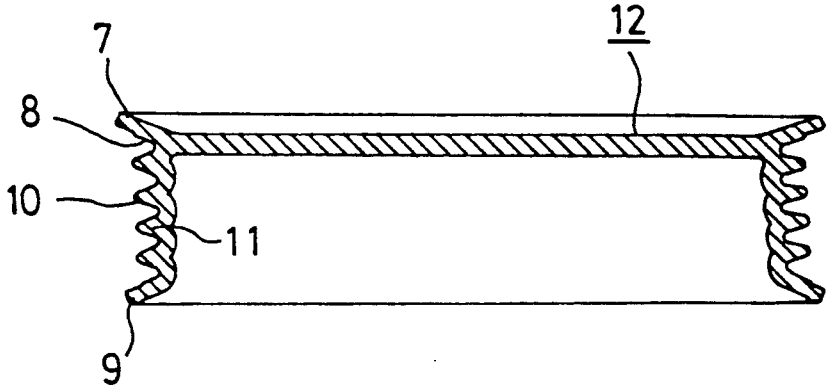
Figure 1L:
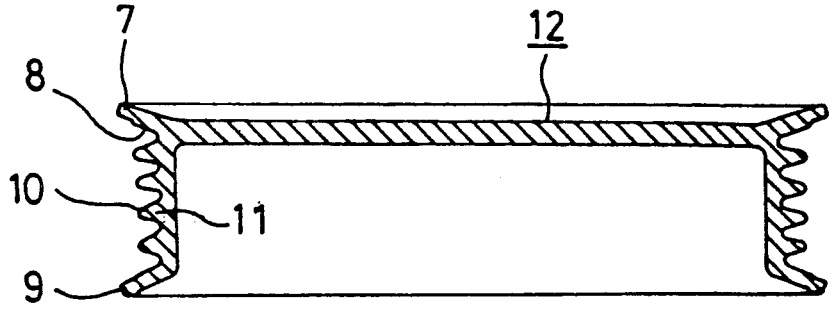

This step may be performed either as shown in FIG. 7, in which a forming plane 63*a* of the circular inner pattern tool 63 and a forming plane 64*a* of the circular outer pattern 64 alternately possess a bottom and peak, respectively and are formed to be engaged with each other, or as shown in FIG. 8, in which a forming plane 63*a* of the circular inner pattern tool 63 is flat in the vertical direction, and a forming plane 64*a* of the circular outer pattern tool 64 is formed in an undulated surface having an alternating bottom and peak. According to the method shown in FIG. 7, and as shown in FIG. 1K, a poly-V pulley 12 made of sheet metal possessing a poly-V groove 10 on the outer surface and having a shell part 11 undulated on the inner surface is fabricated. According to the method shown in FIG. 8, and as shown in FIG. 1L, a poly-V pulley 12 made of sheet metal possessing a poly-V groove 10 on the outer surface and having a shell part 11 being straight inside in the vertical direction is fabricated.

This step may be effected either on the cup-shaped blank 3 after the cup-shaped blank forming step including both the bending step and the corner forming step, or on the cup-shaped blank 3 after the cup-shaped blank forming step consisting only of the bending step.

Besides, between the cup-shaped blank forming step and the ear forming step, a peripheral wall thickening step may be applied if necessary.

Figure 6A:
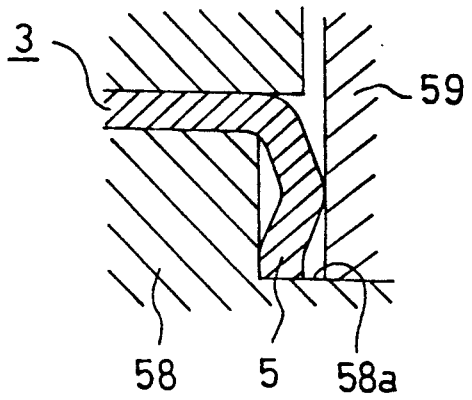
FIG. 6A and FIG. 6B are explanatory drawings of a peripheral wall thickening step.
Figure 6B:
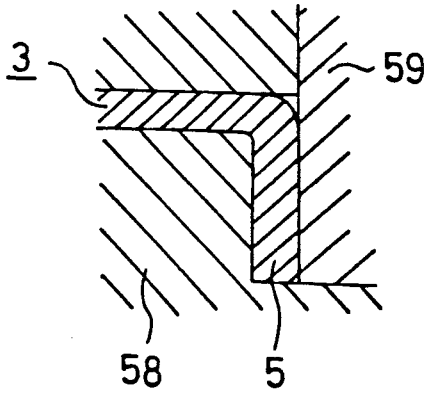

This peripheral wall thickening step is intended to increase the thickness of the peripheral wall by bending and deforming the peripheral wall 5 of the cup-shaped blank 3, and holding and compressing the bent part from inside and outside while holding so that the upper and lower ends of the peripheral wall 5 may not elongate in the vertical direction. This step is achieved by, for example, putting the cup-shaped blank 3 having the peripheral wall 5 bent and deformed in a convex, concave or corrugated shape on the circular inner pattern tool 58 as shown in FIG. 6A, abutting the lower end of the peripheral wall 5 of the cup-shaped blank 3 to the lower surface 58*a* of the circular inner pattern tool 58, compressing the peripheral wall 5 from inside and outside by this circular inner pattern tool 58 and the outer pattern tool 59 to straighten the bending as shown in FIG. 6B, and accordingly increasing the thickness t6 of the peripheral wall 5.

In this manufacturing method of making poly-V pulleys of sheet metal, when forming the first ear 7 by one layer only, the diameter of the metal disc-shaped sheet metal blank may be reduced as compared with the prior art of forming the ear by joining two pieces, and the material cost may be saved, while the weight of the obtained product may be reduced, and furthermore, the axial dimension from one ear 7 to the other ear 9 may be notably shortened advantageously.

Figure 9:
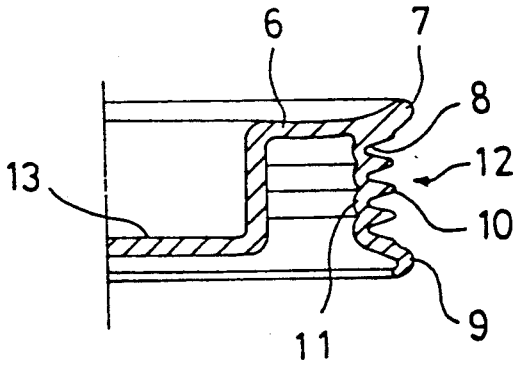
FIG. 9 to FIG. 11 are sectional views of products according to the embodiments of the invention.
Figure 10:
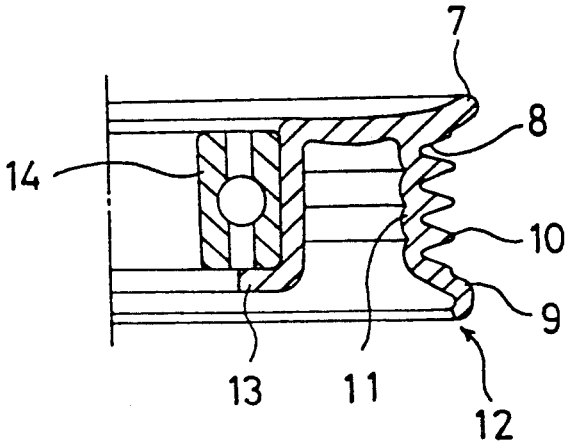
Figure 11:
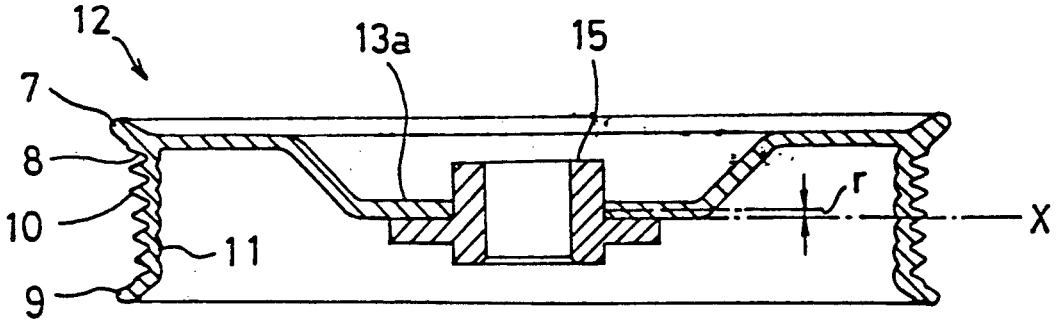

FIG. 9 to FIG. 11 show the products of embodiments of the invention. These products are manufactured according to the method described herein.

The shell part 11 of the poly-V pulley 12 made of sheet metal and shown in FIG. 9 is similar in composition to the shell part 11 explained in FIG. 1K, and poly-V grooves 8, 10 are formed at the outer side, with the inner surface being undulated. Both the first ear 7 and the second ear 9 are of a single layer structure. In this construction, an indentation part 13 is formed concentrically with the shell part 11 in the side plate composed of the bottom wall 6 of the cup-shaped blank 3 mentioned above. Such poly-V pulleys 12 are used by winding a poly-V belt on the shell part 11.

The poly-V pulley 12 made of sheet metal and shown in FIG. 10 has a bearing 14 fitted in the indentation part 13. This is used by fitting a shaft (not shown) to the bearing 14. Meanwhile, by matching the axial center of the bearing 14 with the axial center of the shell part 11, excessive force is hardly applied to the bearing 14 when in use.

The poly-V pulley 12 made of sheet metal and shown in FIG. 11 has the bottom wall 13*a* of the indentation part 13 positioned in the axial center or near the axial center of the forming region of poly-V grooves 8, 10 in the shell part 11. In the diagram, the single-dot chain line X denotes the axial center line in the forming region, r indicates the deviation between the center line X and the bottom wall 13*a*, and the value of r is zero when the bottom wall 13*a* is positioned in the axial center of the forming region. Numeral 15 is a boss for shaft mounting. By this poly-V pulley 12 made of sheet metal, at the position of the bottom wall 13*a* joining with the edge of the annular flange of the boss 15, large bending stresses from the poly-V belt do not occur, and this point where cracks were often formed is conventionally improved, and durability enhanced.

Thus, according to the manufacturing method for making poly-V pulleys of sheet metal by the invention, since the peripheral wall of the cup-shaped blank may be increased in thickness at high efficiency, it is advantageous for the mass production of poly-V pulleys made of sheet metal, while the products obtained by this manufacturing method may be used the same as before without any inconvenience.

What is claimed is:

1. A manufacturing method of making poly-V pulleys from disc-shaped sheet metal blanks, comprising the steps of:

bending the peripheral end part of the sheet metal blank in a concave or convex form forming a bottom wall and a peripheral wall in a specific width range, increasing the wall thickness of the peripheral wall by holding and flattening the peripheral end part so that the diameter of the folded blank may be smaller than the diameter of the sheet metal blank before being folded, forming a cup-shaped blank by bending the thus thickened peripheral wall in one direction, and forming a plurality of V-grooves in the outer side of the peripheral wall of the cup-shaped blank.

2. A manufacturing method of making poly-V pulleys according to claim 1, further comprising the steps of: forming the outer circumference of the corner at the intersection of the peripheral wall and bottom wall at substantially a right-angle shape, forming an annular ear extending outside of the peripheral wall at the root part of the peripheral wall corresponding to the thickness range of the bottom wall and an annular ear extending outside of the peripheral wall at the outer edge of the peripheral wall.

3. A manufacturing method of making poly-V pulleys according to claim 2, wherein the poly-V groove is formed by rolling while holding the peripheral wall of the cup-shaped blank between an inner pattern tool and outer pattern tool.

4. A manufacturing method of making poly-V pulleys according to claim 2, wherein each pattern tool has a forming plane with the forming plane of the inner pattern tool and the forming plane of the outer pattern tool used in forming the poly-V grooves having alternately the bottom and peak of the grooves and are formed so as to be engaged with each other, and wherein the cup-shaped blank is held between the inner pattern tool and the outer pattern tool to form the poly-V grooves by rolling.

5. A manufacturing method of making poly-V pulleys according to claim 2, wherein each pattern tool has a forming plane with the forming plane of the inner pattern tool being flat, and the forming plane of the outer pattern tool being formed as an undulated surface having an alternating bottom and peak, and wherein the cup-shaped blank is held between the inner pattern tool and the outer pattern tool to form poly-V grooves by rolling.

6. A manufacturing method of making poly-V pulleys according to claim 2, further comprising the steps of: forming V-grooves in the root part of the peripheral wall as if tearing the bottom wall of the cup-shaped blank, and forming annular ears extending outside of the peripheral wall along with the rolling process of V-grooves.

7. A manufacturing method of making poly-V pulleys according to claim 6, wherein the poly-V groove is formed by rolling while holding the peripheral wall of the cup-shaped blank between an inner pattern tool and outer pattern tool.

8. A manufacturing method of making poly-V pulleys according to claim 6, wherein each pattern tool has a forming plane with the forming plane of the inner pattern tool and the forming plane of the outer pattern tool used in forming the poly-V grooves having alternately the bottom and peak of the grooves and are formed so as to be engaged with each other, and wherein the cup-shaped blank is held between the inner pattern tool and the outer pattern tool to form the poly-V grooves by rolling.

9. A manufacturing method of making poly-V pulleys according to claim 6, wherein each tool has a forming plane with the forming plane of the inner pattern tool being flat, and the forming plane of the outer pattern tool being formed as an undulated surface having an alternating bottom and peak, and wherein the cup-shaped blank is held between the inner pattern tool and the outer pattern tool to form poly-V grooves by rolling.

10. A manufacturing method of making poly-V pulleys according to claim 1, wherein the poly-V grooves are formed by rolling while holding the peripheral wall of the cup-shaped blank between an inner pattern tool and an outer pattern tool.

11. A manufacturing method of making poly-V pulleys according to claim 1, wherein each pattern tool has a forming plane with the forming plane of the inner pattern tool and the forming plane of the outer pattern tool used in forming the poly-V grooves having alternately the bottom and peak of the grooves and are formed so as to be engaged with each other, and wherein the cup-shaped blank is held between the inner pattern tool and the outer pattern tool to form the poly-V grooves by rolling.

12. A manufacturing method of making poly-V pulleys according to claim 1, wherein each pattern tool has a forming plane with the forming plane of the inner pattern tool being flat, and the forming plane of the outer pattern tool being formed as an undulated surface having an alternating bottom and peak, and wherein the cup-shaped blank is held between the inner pattern tool and the outer pattern tool to form poly-V grooves by rolling.

13. A manufacturing method of making poly-V pulleys according to claim 1, further comprising the steps of: increasing the thickness of the peripheral wall, by bending and deforming the peripheral wall of the cup-shaped blank after the cup-shaped blank forming step, and holding and compressing the bent portion from inside and outside so that the upper and lower ends of the peripheral wall may not elongate in the vertical direction.

* * * * *

UNITED STATES PATENT AND TRADEMARK OFFICE

CERTIFICATE OF CORRECTION

PATENT NO. : 5,129,146

DATED : July 14, 1992

INVENTOR(S) : Toshiaki Kanemitsu et al

It is certified that error appears in the above-identified patent and that said Letters Patent is hereby corrected as shown below:

Claim 1, column 7, line 56, "folded" should be "bent".

Claim 1, column 7, line 58, "folded" should be "bent".

Claim 13, column 10, line 5, "further" should be inserted between the ":" and "increasing".

Signed and Sealed this

Seventh Day of December, 1993

Bruce Lehman

*Attest:*

BRUCE LEHMAN

*Attesting Officer*

*Commissioner of Patents and Trademarks*